United States Patent [19]

Cechanski

[11] Patent Number: 4,496,405

[45] Date of Patent: Jan. 29, 1985

[54] EXPLOSIVE

[76] Inventor: Michael Cechanski, Skördevägen, Number 13, 713 00 Nora, Sweden

[21] Appl. No.: 530,465

[22] Filed: Sep. 8, 1983

[51] Int. Cl.[3] ..... C06B 45/00

[52] U.S. Cl. ..... 149/2; 149/21; 149/42; 149/43; 149/44; 149/46; 149/60; 149/61; 149/76; 149/83; 149/92

[58] Field of Search ..... 149/2, 21, 42, 43, 44, 149/46, 60, 61, 76, 83, 92

[56] References Cited

U.S. PATENT DOCUMENTS 4,391,659 7/1983 Smith ..... 149/2

*Primary Examiner*—Stephen J. Lechert, Jr.

*Attorney, Agent, or Firm*—Richards, Harris & Medlock

[57] ABSTRACT

Explosive composition of water-in-oil, containing as a continuous phase a carbonaceous fuel and as a discontinuous phase an oxygen-releasing aqueous salt solution, the continuous phase containing a water-insoluble lipophilic viscosity index improver for the purpose of controlling the consistency.

7 Claims, No Drawings

EXPLOSIVE

TECHNICAL FIELD

The present invention relates to an explosive composition of water-in-oil, comprising as a continuous phase a carbonaceous fuel and as a discontinuous phase an oxygen-releasing aqueous solution. More particularly, the invention relates to an explosive composition of the just mentioned type which in regard to rheological properties, stability and favourable handling-characteristics is superior to the known technique.

BACKGROUND ART

Explosives of the type water-in-oil in the form of emulsions are well known and commercially available. Emulsion explosives were developed during the sixties and were made subject to patenting in the USA through U.S. Pat. Ser. No. 3,447,978. Many modifications in regard to constituents of both sensitizing and non-sensitizing character have been done since and in many cases have been made subject to patenting.

Explosives of the emulsion type contain in general an aqueous solution of an oxygen-releasing or oxidizing salt which is emulsified as a disperse phase in a continuous carbon-containing fuel phase. Moreover, the explosive often contains a uniformly distributed gaseous component.

Hitherto known explosives of the emulsion type almost always contain, in order to modify viscosity, waxes having a melting point within the range about 55°–60° C., having for their function to provide thickening of the continuous oil phase. Depending on the ratio between wax and oil the viscosity can be varied and changed. When the waxes solidify the emulsion adopts nature and flow properties which are a condition of the waxes. However, with solidification the waxes have a tendency to decrease in volume, and waxes of the paraffin type become brittle and easily breakable due to the structural change. With temperature changes and particularly at low temperatures the structure of the waxes change in an unfavourable direction. This in turn may be contributory cause to structure failure with concomittant exposure of the inner salt solution phase and crystallization. This phenomenon decreases the stability and detonational capability of the explosive.

Also at increased temperature emulsions of this type can be unstable for different reasons, but one of the causes being the tendency of the waxes to bring about release of the oil. Also in regard to the manufacture of the explosive its contents of waxes impose certain restrictions with regard to the procedure. Thus, for example the filling operation in packaging the explosive must take place quickly before the waxes solidify, and the packaging operation should preferably take place at a temperature lower than the solidification temperature of the waxes. It is conceivable to carry out the filling operation with cooled explosive mass, i.e. at a temperature lower than the solidification temperature of the waxes, but in addition to the fact that this is practically unsuitable this may also, considering the treatment of the mass is subjected to, effect the structure of the waxes and thereby negatively influence the stability of the product.

As a further disadvantage of the known technique there may be mentioned the fact that explosive compositions based on waxes are characterized by what is called "short" consistency which has for an effect that the explosive will be easily disintegrated when subjected to external stresses and particularly after longer storage periods.

SUMMARY OF THE INVENTION

The present invention has for its purpose to provide an explosive composition through which the drawbacks of the known technique described above are avoided or at least eliminated. The invention has for its particular object to provide an explosive composition, the rheological properties of which are totally different from those of the known techniques and result in essential advantages in connection with the practical use of the composition.

In connection with the birth of the invention it has been surprisingly found that by adding to the continuous lipophilic phase of the composition a water-insoluble lipophilic viscosity index improver an explosive composition is obtained having properties which are considerably improved in relation to the compositions of the prior art. As is known, the oil phase of the composition comprises only a small weight fraction of the composition as a whole, of the order of less than < about 10 percent by weight and often not more than up to about 5 percent by weight. Against this background it was quite surprising that by adding to the continuous phase a so-called viscosity index improver significant improvement of the properties of the product could be obtained so that the practical use thereof can take place in a much more favourable manner.

The viscosity index improver can be of the conventional type and for example consist of a polymer of a suitable kind, such as acrylate and/or methacrylate copolymers or olefin copolymers. In addition to the presence of viscosity index improver in the oil phase the explosive composition according to the present invention can be said to be characterized by the fact that it is essentially free from the traditional contents of the continuous phase of waxes. In view of this fact several of the disadvantages of the known techniques as briefly introductorily discussed are avoided.

In the usual manner the composition according to the invention contains as a continuous phase any suitable oil, for example mineral oil, vegetable oil or dewaxed paraffin oil. The continuous phase may contain a lipophilic emulsifier of a conventional type, in addition to which the composition, also in a conventional manner, may include a material containing closed cell voids, for example microspheres of glass.

To summarize, the composition according to the present invention may, in addition to the basic constituents, a discontinuous aqueous phase containing oxygen-releasing salts and a continuous oil phase containing viscosity index improver, may include also a lipophilic emulsifier and a material conferring to the composition closed cell voids.

OXYGEN-RELEASING AGENT

This component of the composition according to the invention is not per se characterizing for the invention but can be selected among traditional oxygen-emitters conventionally used in the art. As such agents there may be mentioned different inorganic and organic water-soluble nitrates, such as ammonium nitrate, sodium nitrate, calcium nitrate, sodium perchlorate, ammonium perchlorate, monomethyl amine nitrate, ethylene diamine nitrate, etc., and mixtures thereof. The concentration of oxygen-emitter in the aqueous phase is not critical in the invention but may be varied within broad limits, for example about 40–90 percent by weight based on the aqueous solution thereof. The quantity of water in the composition as a whole may also be selected in accordance with conventional technique and may vary between about 4 and 20 percent by weight based on the weight of the composition.

OIL IN CONTINUOUS PHASE

This component of the composition according to the invention consists of a conventional hydrocarbon fuel in the form of a suitable type of oil, for example mineral oil, vegetable oil or dewaxed paraffin oil. It is primarily this continuous oil phase that is decisive for the properties of the emulsion explosive, both physically and chemically. Among the physical properties there may be mentioned viscosity, consistency, water-resistance, electrical conductivity, temperature stability etc. Among the chemical properties belong for example reactivity with other materials, solubility in polar or non-polar solvents etc. The continuous oil phase also influences the detonation characteristics, for example detonation velocity, detonation, sensitivity at lower temperatures, sensitivity to friction, impact, flammability etc.

As mentioned above an essential feature of the present invention is the fact that the continuous oil phase is essentially free from waxes of the type present in explosives hitherto known. Due to absence of waxes considerably improved properties in many respects are obtained, as previously indicated. In other respects the materials of the continuous oil phase may be selected in accordance with conventional technique and in regard to weight proportion they can constitute conventional fraction thereof. Generally, the composition according to the invention contains about 1–10 percent by weight of continuous oil phase, suitably at most about 5 percent by weight.

VISCOSITY INDEX IMPROVER

In addition to the fact that the continuous oil phase is essentially free from waxes this component of the composition according to the present invention is the essential feature of the present invention. As such improver there may be used additives traditionally used within the lubricating oil art having the character of viscosity index improver. In the following, this component of the composition of the invention will be called VI-improver to simplify matters.

The VI-improver is thus constituted by a water-insoluble lipophilic material, suitably a polymer, such as a copolymer. Such types of products are most frequently presented in a form of an oil solution of the polymer in question, for example in a dewaxed highly refined and neutral paraffin base oil. Particularly preferred polymers are acrylate and/or methacrylate copolymers, for example polyalkyl methacrylate copolymers. Commercially available materials are for example materials of the type Plexol ®, which are sold by Rohm and Haas Company, Philadelphia, PA, USA, and these materials consist of oil solutions of polyacryl methacrylate copolymers. Moreover, there may be mentioned products of the type olefin copolymers.

However, the invention is by no means delimited to any particular types of VI-improvers, but all materials having the function of improving the viscosity index of oil can be used.

The quantity of added VI-improver is not particularly critical and may vary within broad limits. A practically suitable range based on the contents of the composition of VI-improver (i.e. its contents of active component) is about 0.1 to 10 percent by weight, preferably about 0.1–5%, particularly about 0.5–3%.

EMULSIFIER

This component in the explosive composition according to the present invention, which per se is not always obligatory, is part of the continuous oil phase and consists of a lipophilic emulsifier which may be of any conventional type. Thus, for example an emulsifier belonging to the sorbitan group may be used or it may be selected from mono and diglycerides of fatty acids, esters of polyoxyethylenes, phosphate oleyl acids, substituted oxazolines and phosphate esters thereof. Mixtures of different emulsifiers may, of course, also be used. A preferred type of emulsifier is sorbitan monooleate.

The quantity of emulsifier used is not particularly critical and the suitable range is about 0.2–5 percent by weight of same based on the composition as a whole.

CELL VOID MATERIAL

Also this optional constituent of the composition according to the invention is of a conventional character, and the composition may contain this material in a quantity varying within broad limits, for example about 0.25 to about 10 percent by weight of the composition. The material is suitably constituted by glass or plastic microspheres of a traditional type having a particle size within the range about 10 to about 200 μm.

The composition according to this invention may optionally contain up to about 20 percent by weight of an auxiliary fuel of metal type, such as aluminum, aluminum alloy, magnesium or the like.

The composition according to the present invention is manufactured by first preparing different premixtures, mainly an aqueous solution of the oxygen-releasing salt and an oil component containing VI-improver and emulsifier. The emulsion is then prepared by successively adding the oil component to the aqueous solution under stirring until a water-in-oil emulsion is formed. The salt solution is then added at a higher rate.

Then microspheres can be added and admixed and optionally auxiliary fuel, such as aluminum, to the desired concentration.

EXAMPLES

The invention will in the following be further illustrated by specific examples which, however, are not intended to delimit the invention but only to further illustrate same.

PREPARING OF COMPOSITION

The composition according to the invention was prepared in batches of 1000 g starting from three premixes as follows:

Premix 1

Each salt solution was prepared by heating to about 100° C. of ammonium nitrate, sodium nitrate and water. The ammonium nitrate was of an untreated grade of prillsform from KemaNobel AB, Sweden. The sodium nitrate was of the usual technical grade from BASF, West Germany.

Premix 2

The fuel-oil phase contained varying quantities of VI-improver and varying proportions of paraffin oil and mineral oil. In addition, the oil phase contained emulsifier in the form of sorbitan monooleate of the type SPAN ®80. As a reference there was also used oil phase containing microcrystalline wax from WITCO Chemical Co., USA.

Premix 2 was prepared by admixing of the respective ingredients and heating to 80°–85° C.

Premix 3

This component consisted of glass microspheres of the type B 15/250 from 3M Co, USA.

Premix 1 was then added slowly to premix 2 under intense stirring to form a water-in-oil emulsion. After the formation of an emulsion premix 1 could be added at a higher rate to completion in the usual manner.

To the mixture obtained there was then added premix 3 consisting of glass microspheres with mixing until all glass microspheres were evenly distributed in the emulsion.

The quantity of glass microspheres which was constant and was 20 g for all compositions including the reference compositions gave the final explosive a density of 1100–1140 kgs/m$^3$ measured at 20° C.

From the explosive compositions made there were prepared final products by using a simple hand-operated piston squirt at 60°–70° C. to fill two PVC-tubes having the dimensions 25×600 mm. The residual quantity of each 1000 g batch was used for compressibility tests.

The PVC-tubes filled with explosive according to the invention and with reference explosive were used to determine detonation velocity. Initiation was brought about with detonation cap No. 8 at an explosive temperature of 20° C. In the tests the charges were freely dependent.

In the tables below there is presented in table 1 the composition of compositions according to the invention and reference compositions according to conventional technique, In table 2 the results of viscosity measurements for four of the compositions and the reference composition are presented.

These measurements were made at +20° C. with falling ball in a viscometer, type HAEPPLER and according to West German standard DIN-53015. in table 3 compressibility and detonation velocity data for compositions according to the invention, reference explosives and commercially available explosives are given.

It can be added that for determination of consistency of the products a so-called piston rheometer type SK 111 constructed at NitroNobel AB, Sweden, was used. This apparatus consists of a balance and a motor with gear enabling piston speeds of between 0.0375 and 0.161 cm/s. The readable load of the balance is totally 20 kgs, using a switch that can be adjusted to disconnect the motor at lower load. This switch is adjusted by means of a screw. Normally it is adjusted to interrupt the supply of electric current at a load of 10 kgs. Calculation of pressability "$\tau$" is performed according to the following equation:

$$\text{"}\tau\text{"} = 1.306 \times p_1 \times 10^4 \text{dyn/cm}^2$$

where $p_1$ is the balance reading in kgs.

TABLE 1

Compositions used for the experiments.

| Ingredients | Composition percent by weight 1 | 2 | 3 | 4 | 5 | Reference composition, percent by weight A | B |
|---|---|---|---|---|---|---|---|
| Salt solution | | | | | | | |
| Ammonium nitrate (AN) | 74.0 | 72.5 | 72.5 | 72.0 | 72.0 | 73.0 | 73.0 |
| Sodium nitrate (SN) | 10.0 | 10.0 | 10.0 | 10.0 | 10.0 | 10.0 | 10.0 |
| Water ($H_2O$) | 10.0 | 10.0 | 10.0 | 10.0 | 10.0 | 10.0 | 10.0 |
| Oil mixture | | | | | | | |
| Paraffin oil* | 0.4 | 1.2 | 1.6 | 2.0 | 2.0 | | |
| Mineral oil, Kaydol ® | 2.0 | 1.5 | 0.5 | | | 1.0 | 4.0 |
| Emulsifying agent, SPAN ® 80 | 1.0 | 1.0 | 1.0 | 1.0 | 1.0 | 1.0 | 1.0 |
| Thickening copolymer Plexol ® 618 | 0.6 | 1.8 | 2.4 | 3.0 | | | |
| Thickening copolymer Plexol ® 953 | | | | | 3.0 | | |
| Wax (50 paraffin/50 microcrystalline) | | | | | | 3.0 | |
| Sensitizer | | | | | | | |
| Glass microspheres B15/250 | 2.0 | 2.0 | 2.0 | 2.0 | 2.0 | 2.0 | 2.0 |

*The oil solution is assumed to be 40 percent.

TABLE 2

| Ingredients | Composition Parts by weight (grams) 1 | 2 | 3 | 4 | Reference |
|---|---|---|---|---|---|
| Paraffin oil | | | | | |
| (40 percent solution) | 4 | 4 | 4 | | |
| Mineral oil, Kaydol ® | 40 | 40 | 40 | | 40 |
| Emulsifying agent | | | | | |
| SPAN ® 80 | 10 | 10 | 10 | | 10 |
| Thickening copolymer | | | | | |
| Plexol ® 618 | 6 | | | | |
| Plexol ® 953 | | 6 | | | |
| Olefin copolymer 1 | | | 6 | | |
| Olefin copolymer 2 | | | | 6 | |
| VISCOSITY, 20° C. (1 cp = 1 MPas) | 361 | 440 | 328 | 402 | 109 |

TABLE 3

Summary of compressibility and detonation velocity data of compositions from Table 1 and three (3) different commercially available explosives.

| | Composition 1 | 2 | 3 | 4 | 5 | Reference explosive A | B | Commercial explosives C* | D** | E*** |
|---|---|---|---|---|---|---|---|---|---|---|
| Density, kg/m$^3$ | | | | | | | | | | |
| after manufacture, 20° C. | 1100 | 1140 | 1140 | 1100 | 1120 | 1050 | 1140 | | | |
| at testing, 20° C. | 1100 | 1140 | 1140 | 1100 | 1120 | 1050 | 1140 | 1200 | 1200 | 1450 |
| Compressibility "$\tau$", dyn/cm$^2$ | | | | | | | | | | |
| 48 h after manufacture explosive temperature 20° C. | 0.8 (1 week | 1.4 | 2.15 | 2.5 | 3.9 | 1 | 0.5 | | | 4.5 |

TABLE 3-continued

Summary of compressibility and detonation velocity data of compositions from Table 1 and three (3) different commercially available explosives.

| | Composition | | | | | Reference explosive | | Commercial explosives | | |
|---|---|---|---|---|---|---|---|---|---|---|
| | 1 | 2 | 3 | 4 | 5 | A | B | C* | D** | E*** |
| | after manuf.) | | | | | | | | | |
| 3 weeks after manufacture, explosive temperature 20° C. | | | | | | | | | | |
| 6 months or more after manufacture, explosive temperature 20° C. | | | | | | | | 3.9 | 1 | 8 |
| Detonation velocity, m/s Ø 25 × 600 mm, PVC-tube freely hanging initiation with cap No. 8 shot 48 h after manufacture, explosive temperature 20° C. F = failed | 3940 | 4290 | 4100 | 4080 | 4125 | 4400 | F | | | 4000 |

[1]Not compressible over 10 kgs, broken structure.
*Composition C - commercial emulsion explosive Powermax ® from Atlas Powder Co, USA.
**Composition D - modified Powermax ® 200.
***Composition E - commercial NG-explosive, Dynamex ® B from Nitro Nobel AB, Sweden.

The purpose of measuring viscosity, the results of which are presented in Table 2 above, was to gain a practical and useful knowledge about the relative viscosities of the solutions in comparison with a reference product. From the viscosity data given it is easy to realize that an addition of for example 10 percent by weight of oil solution of copolymer can increase the viscosity of the reference mixture at 20° C. by up to 3–4½ times.

The technique according to the present invention provides for considerable advantages in several respects among which the following can be mentioned.

Since the continuous oil phase does no longer contain waxes the manufacturing process will be simplified in that a previously prepared oil solution of VI-improver can be used. This results in a decreased capital requirement for the manufacturing process and also the energy saving can be significant. The technique according to the invention enables decreased process temperature.

The compositions prepared in accordance with the invention possess totally different rheologic properties as compared to wax-based emulsions. The long, coherent and viscous structure of the products according to this invention enables variations in regard to geometrical shape and adaptation of the emulsion explosive to the area of application. Cap-sensitive highly viscous explosive composition may thus be pressed, shaped or extruded to form desired charge shapes.

The physical properties of the product of this invention, namely resistance against viscosity change at varying temperatures, low freezing point, high flashpoint and a viscous neutral and polymer-like structure makes it possible to formulate optimum recipes and thereby optimum properties of the final product.

The present invention is by no means delimited to the embodiments presented above but can be modified in many respects within the scope of the invention. Thus, the type of oxygen-releasing substances is not critical and any type of conventional substances may be used when using the invention. The oil of the continuous oil phase may be of any type compatible with the instant type of explosive products, and the other conventional constituents of the product, namely emulsifier, microspheres and possible auxiliary fuels may be selected among known and conventional materials. Finally, the VI-improver may also be selected among commercial products having for a purpose to modify viscosity index, and those exemplified above only constitute examples of useful materials.

I claim:

1. In an explosive composition of water-in-oil having a discontinuous phase of an aqueous solution containing oxygen-releasing salts, the improvement in combination therewith comprising a high viscosity continuous phase of a carbonaceous fuel which is essentially wax-free having a liquid water-insoluble lipophilic polymer as a viscosity index improver in sufficient amount to produce a final composition adaptable to various geometrical shapes.

2. The composition of claim 1 wherein said polymer is selected from acrylate and/or methacrylate copolymers and olefin copolymers.

3. The composition of claim 1 or 2 in which the continuous phase also contains a lipophilic emulsifier.

4. The composition of claim 1 wherein said polymer is present in an amount from about 0.5 to about 3.0% by weight of the final composition.

5. The composition of claim 2 wherein said polymer is present in an amount from about 0.5 to about 3.0% by weight of the final composition.

6. The composition of claim 1 in which the continuous phase also contains a lipophilic emulsifier and wherein said polymer is present in an amount from about 0.5 to about 3.0% by weight of the final composition.

7. The composition of claim 2 in which the continuous phase also contains a lipophilic emulsifier and wherein said polymer is present in an amount from about 0.5 to about 3.0% by weight of the final composition.

* * * * *

UNITED STATES PATENT AND TRADEMARK OFFICE

CERTIFICATE OF CORRECTION

PATENT NO. : 4,496,405

DATED : January 29, 1985

INVENTOR(S) : Michael Cechanski

It is certified that error appears in the above-identified patent and that said Letters Patent is hereby corrected as shown below:

Column 7, Table 3, change "*Composition C - commercial emulsion explosive Powermax ® from Atlas Powder Co." to --*Composition C - commercial emulsion explosive Powermax ●200 from Atlas Powder Co.--.

Signed and Sealed this

First Day of October 1985

[SEAL]

*Attest:*

*Attesting Officer*

DONALD J. QUIGG

*Commissioner of Patents and Trademarks—Designate*